US010889916B2

(12) United States Patent
Shimamoto et al.

(10) Patent No.: US 10,889,916 B2
(45) **Date of Patent: *Jan. 12, 2021**

(54) CELLULOSE ACETATE FIBER, CELLULOSE ACETATE FIBER MOLDED ARTICLE, AND METHODS RESPECTIVELY FOR PRODUCING SAID CELLULOSE ACETATE FIBER AND SAID CELLULOSE ACETATE FIBER MOLDED ARTICLE

(71) Applicant: DAICEL CORPORATION, Osaka (JP)

(72) Inventors: Shu Shimamoto, Tokyo (JP); Shizuka Okada, Himeji (JP); Hiroki Taniguchi, Himeji (JP); Toshikazu Nakamura, Himeji (JP)

(73) Assignee: DAICEL CORPORATION, Osaka (JP)

( * ) Notice: Subject to any disclaimer, the term of this patent is extended or adjusted under 35 U.S.C. 154(b) by 527 days.

This patent is subject to a terminal disclaimer.

(21) Appl. No.: 15/111,688

(22) PCT Filed: Jan. 15, 2014

(86) PCT No.: PCT/JP2014/000169

§ 371 (c)(1),
(2) Date: Jul. 14, 2016

(87) PCT Pub. No.: WO2015/107565

PCT Pub. Date: Jul. 23, 2015

(65) Prior Publication Data

US 2016/0333500 A1 Nov. 17, 2016

(51) Int. Cl.

| | |
|---|---|
| ***C08B 3/06*** | (2006.01) |
| ***D01F 2/28*** | (2006.01) |
| ***D04H 1/728*** | (2012.01) |
| ***D01D 5/00*** | (2006.01) |
| ***D04H 1/425*** | (2012.01) |

(52) U.S. Cl.

CPC ..... *D01F 2/28* (2013.01); *D01D 5/003* (2013.01); *D04H 1/425* (2013.01); *D04H 1/728* (2013.01); *D10B 2201/28* (2013.01); *D10B 2401/024* (2013.01); *D10B 2401/12* (2013.01)

(58) Field of Classification Search

CPC ..... C08B 3/06
USPC ..... 536/69
See application file for complete search history.

(56) References Cited

U.S. PATENT DOCUMENTS 2,129,052 A 9/1938 Fordyce

FOREIGN PATENT DOCUMENTS

| | | | |
|---|---|---|---|
| CN | 101469034 | A | 7/2009 |
| CN | 102597824 | A | 7/2012 |
| EP | 2472296 | A1 | 7/2012 |
| JP | 58-34801 | A | 3/1983 |
| JP | 1-13481 | B2 | 3/1989 |
| JP | 4-261401 | A | 9/1992 |
| JP | 7-268724 | A | 10/1995 |
| JP | 3749746 | B2 | 7/2009 |

OTHER PUBLICATIONS

Office Action dated Feb. 21, 2017, in Chinese Patent Application No. 201480073311.9, with partial English translation.
German Office Action, dated Jul. 7, 2017, for German Patent Application No. 112014006175.1, with an English translation.
English translation of Written Opinion dated Mar. 25, 2014, in PCT International Application No. PCT/JP2014/000169.
International Search Report for PCT/JP2014/000169 dated Mar. 25, 2014.
Jaeger et al., "Electrospinning of Ultra-Thin Polymer Fibers", Macromol. Symp. 127, (1998), pp. 141-150.
Proceedings of the Hokkaido Branch of the Japan Wood Research Society, Nov. 9, 2010, vol. 42, pp. 14-16, the Hokkaido Branch of the Japan Wood Research Society.
Rakhmanberdiev et al., "Water-Soluble Fibre From Cellulose Acetate", Fiber Chemistry, 74, 6(2), p. 219.
Rakhmanberdiev et al., "Water-Soluble Fibre From Cellulose Acetate", Fiber Chemistry, 79, 10(4), pp. 370-371.

*Primary Examiner* — Shaojia A Jiang
*Assistant Examiner* — Everett White
(74) *Attorney, Agent, or Firm* — Birch, Stewart, Kolasch & Birch, LLP

(57) ABSTRACT

Provided are a cellulose acetate fiber and a cellulose acetate fiber molded article which are excellent in water solubility and biodegradability and are small in load onto the natural environment even when allowed to stand still in the environment. The invention provides a cellulose acetate fiber containing cellulose acetate having a total degree of acetyl substitution of 0.4 to 1.3 and a compositional distribution index (CDI) of 2.0 or less as well as a cellulose acetate fiber molded article.

5 Claims, 1 Drawing Sheet

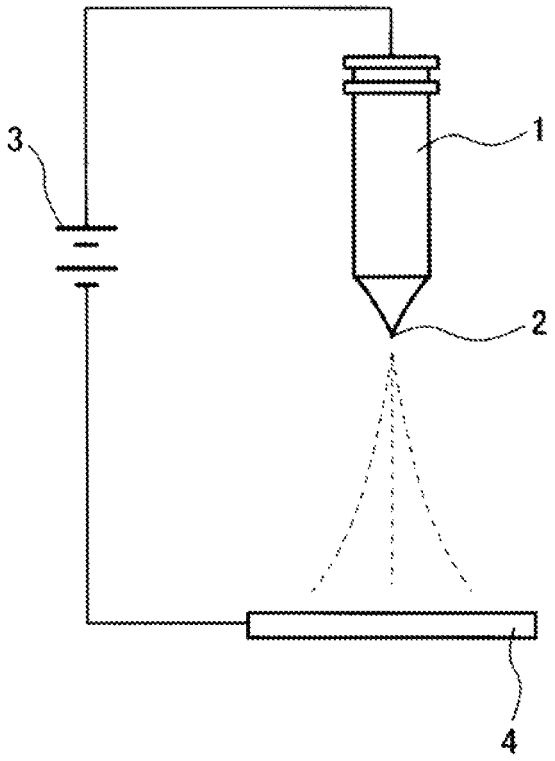
3
1
2
4

CELLULOSE ACETATE FIBER, CELLULOSE ACETATE FIBER MOLDED ARTICLE, AND METHODS RESPECTIVELY FOR PRODUCING SAID CELLULOSE ACETATE FIBER AND SAID CELLULOSE ACETATE FIBER MOLDED ARTICLE

TECHNICAL FIELD

The present invention relates to a cellulose acetate fiber and a cellulose acetate fiber molded article each having water solubility and biodegradability.

BACKGROUND ART

A cellulose acetate fiber is produced mainly by dry spinning. Specifically, cellulose acetate is dissolved into dichloromethane, acetone or some other organic solvent in accordance with the degree of cellulose acetate substitution; this solution is jetted out through a spinneret having spinning holes; and then the jetted out solution is dried with hot wind to be made into a fibrous state. For reference, cellulose acetate is varied in solvent in which the cellulose acetate is soluble in accordance with the degree of cellulose acetate substitution (degree of acetyl substitution).

For example, according to Patent Literature 1, cellulose acetate high in degree of substitution is hydrolyzed with an acid to be changed in total degree of substitution, thereby being changed in solubility in acetone and water. This literature demonstrates that cellulose acetate having a degree of acetyl substitution of 1.18 to 0.88 is insoluble in water but comes to have affinity therewith, and further cellulose acetate having a degree of acetyl substitution of 0.88 to 0.56 is soluble in water.

Such a water-soluble cellulose acetate, in particular, a water-soluble cellulose acetate having an degree of acetyl substitution of 0.4 to 1.1 shows no solubility in an acetone solvent. It is therefore necessary to use an especial technique for spinning the acetate.

For example, Patent Literature 2 describes that cellulose acetate having a degree of acetyl substitution of 0.49 is dissolved into water at a concentration of 15 wt % to yield a dope and this dope is dry-spun under the following conditions: the winding-up speed is 100 m/minute; the processing temperature is 400° C.; the jet-out quantity is 2.22 g/minute; the number of spinneret holes is 12; and spinneret hole diameter d is 0.5 m/m. The literature describes that the resulting yam lines have a single filament denier (Fd) of 16.7 d (diameter: about 70 μm) (Example 3). As described above, a yarn line body yielded by dry spinning using water as a solvent is very thick (Fd is large).

Patent Literature 3 discloses a technique of attaining dry spinning by dissolving a cellulose derivative into water, or dissolving the derivative together with water into a water-soluble alcohol or a water-soluble ketone, or a mixture thereof. Specifically, with respect to cellulose acetate having an acetyl group content of 5 mmol/g, a fiber having an Fd of 10 (diameter: about 50 μm) is yielded by dry spinning using hot water of 95° C.

Next, disclosed is also a technique of wet-spinning a water-soluble cellulose. Non-Patent Literature 1 discloses a wet spinning technique of jetting out, into acetone, cellulose acetate dissolved in acetic acid. The literature describes that this techniques gives a fiber having an Fd of 7 to 8 (diameter: about 45 μm)

Non-Patent Literature 2 describes that isopropyl alcohol (IPA) is used as a coagulating liquid to yield a fiber having an Fd of 3.2 (diameter: about 30 μm) to 7.4 (diameter: 45 μm).

Non-Patent Literature 3 describes that from cellulose acetate species having degrees of acetyl substitution (DS) of 1.5 and 2.4, respectively, cellulose acetate nanofibers are prepared by an electrospinning method. Specifically, the literature describes that a solution of cellulose acetate (CA) having a DS of 2.4 in acetone (12% wt) is spun so that the resulting fiber has uneven fiber diameters and includes many generated beads; and that an aqueous solution of cellulose acetate (CA) having a DS of 1.5 in 85% (v/v) acetic acid (17% wt) is spun so that production of nanofibers succeeds which are small in quantity of formed beads and have an average fiber diameter of 265.6 nm (Fd: 0.000632954). The literature also describes that it has been made evident that in the electrospinning, the volatility of the solvent largely affects the fiber diameter of the resulting fibers.

Furthermore, Non-Patent Literature 4 describes a technique of electrospinning a water-soluble polymer, polyvinyl alcohol (PVA).

CITATION LISTS

Patent Literatures

PTL 1: USP No. 2129052
PTL 2: JP H01-013481 B
PTL 3: JP H07-268724 A

Non-Patent Literatures

Non-Patent Literature 1: Fiber Chemistry 74 6(2)219
Non-Patent Literature 2: Fiber Chemistry 79 10(4)370
Non-Patent Literature 3: Proceedings of the Hokkaido Branch of the Japan Wood Research Society, Nov. 9, 2010, vol. 42, pp. 14-16, the Hokkaido Branch of the Japan Wood Research Society
Non-Patent Literature 4: Macromol. Symp. 127, 141-150 (1998)

SUMMARY OF INVENTION

Technical Problem

However, any conventional cellulose acetate fiber has neither sufficient water solubility nor sufficient biodegradability to result in a problem that when a cellulose acetate fiber is allowed to stand still in an environment while an original form of the fiber is kept over a long term, the fiber gives a load onto the natural environment. Thus, there remains a theme of realizing a cellulose acetate fiber small in load onto the natural environment.

Solution to Problem

In order to solve the above problems, the present inventors have intensively studied, and as a result have found that a cellulose acetate fiber containing cellulose acetate having a predetermined total degree of acetyl substitution and a predetermined compositional distribution index (CDI) is excellent in water solubility and biodegradability. This finding has led to the completion of the present invention.

More specifically, the present invention provides a cellulose acetate fiber comprising cellulose acetate having a total degree of acetyl substitution of 0.4 to 1.3, and a compositional distribution index (CDI) of 2.0 or less, the fiber having an average fiber diameter of 0.1 to 1 μm.

The present invention also provides a cellulose acetate fiber molded article comprising the above-mentioned cellulose acetate fiber.

Furthermore, the present invention also provides a method for producing a cellulose acetate fiber, the method comprising: a step of electrospinning a spinning dope in which cellulose acetate having a total degree of acetyl substitution of 0.4 to 1.3 and a compositional distribution index (CDI) of 2.0 or less is dissolved in water or a water/mixed solvent.

The present invention also provides a method for producing a cellulose acetate fiber molded article, the method comprising: a step of electrospinning a spinning dope in which cellulose acetate having a total degree of acetyl substitution of 0.4 to 1.3 and a compositional distribution index (CDI) of 2.0 or less is dissolved in water or a water/mixed solvent; and a step of forming a molded article by using a resulting fiber.

Advantageous Effects of Invention

The cellulose acetate fiber and the cellulose acetate fiber molded article according to the present invention are excellent in water solubility and also excellent in biodegradability. Even when the fiber and the molded article are allowed to stand still in an environment, a load onto the natural environment is small. Thus, when the fiber or the molded article is processed into, for example, a cigarette filter, this filter can be obtained with water solubility and excellent filtrating performance. In case where a cigarette is thrown away into an environment after smoking, a cigarette filter can be realized which is dissolved and disappeared by rainwater or the like.

BRIEF DESCRIPTION OF DRAWINGS

FIG. 1 is a schematic view illustrating an example of an electrospinning device for producing a cellulose acetate fiber according to the present invention.

DESCRIPTION OF EMBODIMENTS

Hereinbelow, one of preferred embodiments of the present invention will be specifically described.

[Cellulose Acetate]

A cellulose acetate fiber according to the present invention is preferably contains cellulose acetate having a total degree of acetyl substitution of 0.4 to 1.3 and a compositional distribution index (CDI) of 2.0 or less.

(Total Degree of Acetyl Substitution)

The total degree of acetyl substitution of cellulose acetate contained in the cellulose acetate fiber according to the present invention is preferably 0.4 to 1.3, more preferably 0.5 to 1.0, even more preferably 0.6 to 0.95. When the total degree of acetyl substitution is 0.4 to 1.3, the cellulose acetate is excellent in solubility in water or a water/alcohol mixed solvent. If the total degree is out of the range of 0.4 to 1.3, the cellulose acetate becomes insufficient in solubility in water or a water/alcohol mixed solvent.

The total degree of acetyl substitution can be measured by a known titration method in which cellulose acetate is dissolved in water to determine the degree of substitution of the cellulose acetate. Alternatively, the total degree of acetyl substitution may be measured by converting cellulose acetate (sample) into completely-derivatized cellulose acetate propionate (CAP) in the same manner as when the measured value of half-width of compositional distribution that will be described later is determined and subjecting a solution obtained by dissolving the completely-derivatized cellulose acetate propionate in deuterated chloroform to NMR.

Alternatively, the total degree of acetyl substitution may be determined by determining an acetyl value according to a method for measuring an acetyl value specified in ASTM: D-817-91 (Standard Test Methods of Testing Cellulose Acetates) and converting the acetyl value into the total degree of acetyl substitution using the following formula. This is the most common method for determining the degree of substitution of cellulose acetate.

$$DS=162.14\times AV\times 0.01/(60.052-42.037\times AV\times 0.01)$$

DS: Total degree of acetyl substitution

AV: Acetyl value (%)

First, 500 mg of dried cellulose acetate (sample) is precisely weighed and dissolved in 50 mL of a mixed solvent of ultrapure water and acetone (volume ratio 4:1), and then 50 mL of a 0.2 N aqueous sodium hydroxide solution is added thereto for saponification at 25° C. for 2 hours. Then, 50 mL of 0.2 N hydrochloric acid is added, and the amount of released acetic acid is determined by titration with a 0.2 N aqueous sodium hydroxide solution (0.2 N sodium hydroxide normal solution) using phenolphthalein as an indicator. Further, a blank test (test without any sample) is also performed in the same manner. Then, AV (acetyl value) (%) is calculated according to the following formula:

$$AV(\%)=(A-B)\times F\times 1.201/\text{sample weight (g)}, \text{ wherein}$$

A: titer (mL) of 0.2 N sodium hydroxide normal solution,

B: titer (mL) of 0.2 N sodium hydroxide normal solution in blank test, and

F: factor of 0.2 N sodium hydroxide normal solution.

The total degree of acetyl substitution of cellulose acetate contained in the cellulose acetate fiber according to the present invention can be reduced by hydrolyzing the cellulose acetate in the presence of acetic acid, an excessive amount of water or alcohol relative to the amount of acetyl groups, and a catalyst (partial deacetylation reaction; ripening).

(Weight-Average Degree of Polymerization (DPw))

In the present invention, the weight-average degree of polymerization (DPw) is a value determined by GPC-light scattering using cellulose acetate propionate obtained by propionylating all the residual hydroxyl groups of cellulose acetate (sample).

The weight-average degree of polymerization (DPw) is determined by converting cellulose acetate (sample) into completely-derivatized cellulose acetate propionate (CAP) in the same manner as when the measured value of half-width of compositional distribution that will be described later is determined and analyzing the completely-derivatized cellulose acetate propionate by size exclusion chromatography (GPC-light scattering).

It is to be noted that light scattering detection is generally difficult to perform in an aqueous solvent. This is because an aqueous solvent generally contains a large amount of foreign matter and is likely to be secondarily contaminated even after once being purified. Further, there is a case where the expansion of molecular chains in an aqueous solvent is unstable due to the influence of ionic dissociable groups present in a trace amount. When a water-soluble inorganic salt (e.g., sodium chloride) is added to prevent this, there is a case where a dissolved state becomes unstable so that an assembly is formed in an aqueous solution. One of effective methods to avoid such a problem is that water-soluble cellulose acetate is derivatized so as to be soluble in an organic solvent that contains less foreign matter and is less likely to be secondarily contaminated in order to perform GPC-light scattering measurement in the organic solvent.

(Compositional Distribution Index (CDI))

The compositional distribution index (CDI) is defined as the ratio of the measured value to the theoretical value of half-width of compositional distribution [(measured value of half-width of compositional distribution)/(theoretical value of half-width of compositional distribution)]. The half-width of compositional distribution is also simply referred to as "half-width of substitution degree distribution".

The lower limit value of the compositional distribution index (CDI) is 0. This can be achieved by, for example, a special synthetic technique in which only the 6-position of a glucose residue is acetylated at a selectivity of 100% without acetylating the other positions. However, such a synthetic technique is unknown. When all the hydroxyl groups of glucose residues are acetylated and deacetylated with the same probability, CDI is 1.0.

The compositional distribution index (CDI) of cellulose acetate contained in the cellulose acetate fiber according to the present invention is preferably 2.0 or less, more preferably 1.8 or less, even more preferably 1.6 or less. If the compositional distribution index (CDI) is more than 2.0, the cellulose acetate is hard to be electrospun so that it is not made into a fiber, or does not give a fiber sufficient in solubility in water and biodegradability.

The compositional distribution index (CDI) of cellulose acetate contained in the cellulose acetate fiber according to the present invention can be determined by high-performance liquid chromatography (HPLC) analysis.

Before HPLC analysis is performed to determine the compositional distribution index, residual hydroxyl groups in the molecule of cellulose acetate are derivatized as pretreatment. The purpose of the pretreatment is to convert cellulose acetate with a low degree of substitution into a derivative that can be readily dissolved in an organic solvent so that HPLC analysis can be performed. More specifically, residual hydroxyl groups in the molecule are completely propionylated to obtain completely-derivatized cellulose acetate propionate (CAP), and the completely-derivatized cellulose acetate propionate (CAP) is analyzed by HPLC to determine the half-width of compositional distribution (measured value). Here, the derivatization should be completely performed so that the molecule contains no residual hydroxyl group and only acetyl groups and propionyl groups are present. That is, the sum of the total degree of acetyl substitution (DSac) and the total degree of propionyl substitution (DSpr) is 3. This is because a relational expression: DSac+DSpr=3 is used to create a calibration curve for converting the abscissa (elution time) of an HPLC elution curve of CAP into the degree of acetyl substitution (0 to 3).

The complete derivatization of cellulose acetate can be performed by allowing anhydrous propionic acid to act on the cellulose acetate in a mixed solvent of pyridine/N,N-dimethylacetamide using N,N-dimethylaminopyridine as a catalyst. More specifically, propionylation is performed at a temperature of 100° C. for a reaction time of 1.5 to 3.0 hours using a mixed solvent [pyridine/N,N-dimethylacetamide=1/1 (v/v)] as a solvent in an amount of 20 parts by weight relative to cellulose acetate (sample), anhydrous propionic acid as a propionylating agent in an amount of 6.0 to 7.5 equivalents relative to the hydroxyl groups of the cellulose acetate, and N,N-dimethylaminopyridine as a catalyst in an amount of 6.5 to 8.0 mol % relative to the hydroxyl groups of the cellulose acetate. Then, after the reaction, methanol is used as a precipitation solvent to obtain completely-derivatized cellulose acetate propionate as a precipitate. More specifically, for example, 1 part by weight of the reaction mixture is fed into 10 parts by weight of methanol at room temperature to form a precipitate, and the obtained precipitate is washed with methanol five times and vacuum-dried at 60° C. for 3 hours to obtain completely-derivatized cellulose acetate propionate (CAP).

The HPLC analysis is performed in the following manner. Two or more cellulose acetate propionate reference samples different in the total degree of acetyl substitution are analyzed by HPLC under predetermined measuring conditions using a predetermined measuring apparatus. Then, the analytical values of these reference samples are plotted to create a calibration curve [curve, generally, cubic curve showing the relationship between the elution time and the degree of acetyl substitution (0 to 3) of cellulose acetate propionate], and the compositional distribution index (CDI) of cellulose acetate contained in the cellulose acetate fiber according to the present invention can be determined from the calibration curve.

More specifically, the compositional distribution index (CDI) can be determined by converting the abscissa (elution time) of an HPLC (reversed-phase HPLC) elution curve of cellulose acetate propionate measured under predetermined treatment conditions into the degree of acetyl substitution (0 to 3).

A method for converting the elution time into the degree of acetyl substitution may be a method described in, for example, JP 2003-201301 A (paragraphs [0037] to [0040]). For example, the conversion of the elution curve into a compositional distribution curve may be performed by using a conversion formula for determining the degree of acetyl substitution (DS) from the elution time (T). The conversion formula is obtained by measuring the elution times of two or more (e.g., four or more) samples different in the total degree of acetyl substitution under the same measuring conditions. More specifically, the function of the calibration curve [usually, the following quadratic] is determined by the method of least squares from the relationship between the elution time (T) and the degree of acetyl substitution (DS):

$$DS=aT^2+bT+c$$

(wherein DS represents the degree of acetyl substitution, T represents the elution time, and a, b, and c each represent the coefficient of the conversion equation).

Then, from the conversion equation as described above, a compositional distribution curve [compositional distribution curve of cellulose acetate propionate with the abundance of cellulose acetate propionate on the ordinate and the degree of acetyl substitution on the abscissa] is determined. In this compositional distribution curve, the half-width of compositional distribution curve is determined for the maximum peak (E) corresponding to the average degree of substitution in the following manner. More specifically, a base line "A-B" tangent to the low substitution degree-side base point (A) and the high substitution degree-side base point (B) of the peak (E) is drawn, and the height of the maximum peak (E) from this base line is determined. When the degree of acetyl substitution is on the abscissa (x-axis) and the abundance at each value of this substitution degree is on the ordinate (y-axis), the half-width is the width of the compositional distribution curve at the half of the height of the maximum peak E in the chart. The half-width is an index of the variation in the distribution. The half-width of substitution degree distribution can be determined by high-performance liquid chromatography (HPLC) analysis. It is to be noted that a method for converting the abscissa (elution time) of an HPLC elution curve of cellulose ester to the degree of substitution (0 to 3) is described in JP 2003-201301 A (paragraphs [0037] to [0040]).

Such a half-width of the compositional distribution curve reflects that the molecular chains of cellulose acetate propionate contained in a sample are different in retention time depending on the degree of acetylation of hydroxyl groups on the glucose rings of each of the constituent polymer chains. Therefore, the width of the retention time ideally indicates the width of compositional distribution (in terms of the degree of substitution). However, a high-performance liquid chromatograph includes a tube section that does not contribute to partition, such as a guide column for protecting a column). Therefore, the width of the retention time that is not attributable to the width of compositional distribution is often included as an error caused by the structure of the measuring apparatus. As described above, this error is influenced by the length and inner diameter of the column and the length and route from the column to a detector, and therefore varies depending on the structure of the apparatus.

For this reason, the half-width of the compositional distribution curve of cellulose acetate (measured value of half-width of compositional distribution) can be usually determined as a corrected value based on a correction formula represented by the following formula (1). The use of such a correction formula makes it possible to determine a more accurate measured value of the half-width of compositional distribution as a constant (almost constant) value irrespective of the type of measuring apparatus used (and irrespective of measuring conditions used).

$$Z=(X^2-Y^2)^{1/2} \quad \text{(1), wherein}$$

X is an uncorrected half-width of a compositional distribution curve determined with a predetermined measuring apparatus under predetermined measuring conditions, and Y is an apparatus constant defined by the following formula:

$$Y=(a-b)\times/3+b(0\leq x\leq 3), \text{ wherein}$$

a: apparent half-width of compositional distribution of cellulose acetate having a total degree of substitution of 3 determined with the same measuring apparatus under the same measuring conditions as in the determination of the above X (actually, the cellulose acetate has a total degree of substitution of 3 and therefore does not have a substitution degree distribution), b: apparent half-width of compositional distribution of cellulose propionate having a total degree of substitution of 3 determined with the same measuring apparatus under the same measuring conditions as in the determination of the above X, and x: total degree of acetyl substitution of a measurement sample ($0\leq x\leq 3$).

In the above formula, "cellulose acetate (or cellulose propionate) having a total degree of substitution of 3" refers to cellulose ester in which all the hydroxyl groups are esterified, and actually (or ideally) refers to cellulose acetate (or cellulose propionate) not having a half-width of compositional distribution (i.e., having a half-width of compositional distribution of 0).

The compositional distribution index (CDI) is determined from the Z (measured value of half-width of compositional distribution) based on the following formula (2):

$$CDI=Z/Z_0 \quad \text{(2), wherein}$$

$Z_0$ is a theoretical value of the half-width of compositional distribution of a compositional distribution curve generated when acetylation and partial deacetylation in the preparation of all the partially-substituted cellulose acetates occur with equal probability among all the hydroxyl groups (or acetyl groups) of all the molecules.

The $Z_0$ (theoretical value of half-width of compositional distribution) is a theoretical value that can be stochastically calculated by the following formula (3):

[Formula 1]

Theoretical value of half-width of compositional distribution $$=2.35482\sqrt{mpq}/DPw \quad \text{(3), wherein}$$

m: total number of hydroxyl groups and acetyl groups in one molecule of cellulose acetate, p: probability that hydroxyl groups in one molecule of cellulose acetate are acetyl-substituted, $q=1-p$, and DPw: weight-average degree of polymerization (value determined by GPC-light scattering using cellulose acetate propionate obtained by propionylating all the residual hydroxyl groups of cellulose acetate).

Further, the $Z_0$ (theoretical value of half-width of compositional distribution) can be represented by the following formula using the degree of substitution and the degree of polymerization. In the present invention, the following formula (4) is used as a definitional formula to determine the theoretical value of half-width of compositional distribution:

[Formula 2]

$$\text{Theoretical value of half-width of compositional distribution} = \frac{2.35482\times\sqrt{3\times DPw\times\frac{DS}{3}\times\left(1-\frac{DS}{3}\right)}}{DPw}, \quad (4)$$

wherein

DS: total degree of acetyl substitution, and

DPw: weight-average degree of polymerization (value determined by GPC-light scattering using cellulose acetate propionate obtained by propionylating all the residual hydroxyl groups of cellulose acetate).

Here, as described above, the weight-average degree of polymerization (DPw) of cellulose acetate can be determined by performing GPC-light scattering measurement after conversion into propionylated cellulose acetate.

More strictly, the formulas (3) and (4) should take the distribution of polymerization degree into consideration. In this case, "DPw" in the formulas (3) and (4) should be replaced with the function of distribution of polymerization degree, and the entire formulas should be integrated from a polymerization degree of 0 to infinity. However, the formulas (3) and (4) give a theoretical value with an approximately sufficient accuracy as long as DPw is used. If DPn (number-average degree of polymerization) is used, the influence of distribution of polymerization degree cannot be ignored, and therefore DPw should be used.

The Z of the compositional distribution curve (measured value of half-width of compositional distribution) of cellulose acetate contained in the cellulose acetate fiber according to the present invention is preferably 0.12 to 0.34, more preferably 0.13 to 0.25.

The above-described theoretical formula of compositional distribution gives a value stochastically calculated on the assumption that acetylation and deacetylation all independently and evenly proceed, that is, a calculated value according to the binomial distribution. Such an ideal situation does not occur in reality. The compositional distribution of cellulose ester is much wider than that stochastically determined according to the binomial distribution unless a special measure is taken so that the hydrolysis reaction of cellulose acetate approaches an ideal random reaction and/or compositional fractionation occurs in post-treatment performed after the reaction.

One of possible special measures taken against the reaction is, for example, to maintain the system under such conditions that deacetylation and acetylation are in equilibrium. However, this case is not preferred because decomposition of cellulose proceeds by an acid catalyst. Another special measure taken against the reaction is to use such reaction conditions that the deacetylation rate of a low-substituted substance is reduced. However, a specific method to achieve this has not heretofore been known. That is, there is no known special measure taken against the reaction to stochastically control the substitution degree distribution (compositional distribution) of cellulose ester according to the binomial distribution. Further, various circumstances such as a non-uniform acetylation process (acetylation process of cellulose) and partial or temporal precipitation caused by water added stepwise in a ripening process (hydrolysis process of cellulose acetate) act to make the substitution degree distribution (compositional distribution) wider than the binomial distribution. It is actually impossible to avoid all of them to achieve ideal conditions. This is similar to the fact that an ideal gas is just an ideal product and an actual gas behaves somewhat differently from an ideal gas.

According to the present invention, as will be described later, the compositional distribution of cellulose acetate can be controlled by performing posttreatment under adjusted conditions after the hydrolysis process of cellulose acetate. According to literatures (CiBment, L., and Rivibre, C., Bull. SOC. chim., (5)1, 1075 (1934), Sookne, A. M., Rutherford, H. A., Mark, H., and Harris, M. J. Research Natl. Bur. Standards, 29, 123 (1942), A. J. Rosenthal, B. B. White Ind. Eng. Chem., 1952, 44 (11), pp. 2693 to 2696), molecular weight-dependent fractionation and minor fractionation associated with the degree of substitution (chemical composition) occur in the precipitation fractionation of cellulose acetate having a degree of substitution of 2.3, but there is no report that remarkable fractionation can be achieved based on the degree of substitution (chemical composition) as in the case of the present invention. It has not been verified that the substitution degree distribution (chemical composition) can be controlled by dissolution fractionation or precipitation fractionation as in the case of the present invention.

Another measure found by the present inventors to narrow the compositional distribution is to perform the hydrolysis reaction (ripening reaction) of cellulose acetate at a high temperature of 90° C. or higher (or higher than 90° C.). Irrespective of the fact that the degree of polymerization of a product obtained by a high-temperature reaction has not heretofore been analyzed or investigated in detail, it has been believed cellulose decomposition preferentially occurs in a high-temperature reaction at 90° C. or higher. This idea is considered as an assumption (stereotype) based on only the consideration of viscosity. The present inventors have found that when cellulose acetate with a low degree of substitution is obtained by performing the hydrolysis reaction of cellulose acetate in a large amount of acetic acid at a high temperature of 90° C. or higher (or higher than 90° C.) in the presence of a strong acid, preferably sulfuric acid, the degree of polymerization does not reduce, but viscosity reduces as CDI reduces. That is, the present inventors have revealed that the reduction in viscosity associated with the high-temperature reaction is not caused by a reduction in the degree of polymerization but is based on a reduction in structural viscosity caused by narrowing the substitution degree distribution (compositional distribution). When the hydrolysis of cellulose acetate is performed under the above conditions, not only a forward reaction but also a reverse reaction occurs, and therefore the CDI of a product (cellulose acetate with low degree of substitution) is very small and the solubility of the product in water is significantly improved. On the other hand, when the hydrolysis of cellulose acetate is performed under conditions where a reverse reaction is less likely to occur, the substitution degree distribution (compositional distribution) is widened due to various factors, and therefore the amounts of poorly water-soluble cellulose acetate having a total degree of acetyl substitution of less than 0.4 and cellulose acetate having a total degree of acetyl substitution of higher than 1.1 contained in a product are increased so that the solubility of the product in water is reduced as a whole.

A small compositional distribution index (CDI) of cellulose acetate contained in the cellulose acetate fiber according to the present invention means that acetyl groups are relatively uniformly dispersed in the cellulose acetate.

(Production of Cellulose Acetate)

Cellulose acetate contained in the cellulose acetate fiber according to the present invention can be produced through, for example, a hydrolysis (ripening) step (A) of hydrolyzing cellulose acetate with a medium to high degree of substitution, a precipitation step (B), and a washing and neutralization step (C) that is performed if necessary.

[(A) Hydrolysis Step (Ripening Step)]

In this step, cellulose acetate with a medium to high degree of substitution (hereinafter, sometimes referred to as "raw material cellulose acetate") is hydrolyzed. The total degree of acetyl substitution of cellulose acetate with a medium to high degree of substitution used as a raw material is, for example, 1.5 to 3, preferably 2 to 3. The raw material cellulose acetate may be commercially-available cellulose diacetate (total degree of acetyl substitution: 2.27 to 2.56) or cellulose triacetate (total degree of acetyl substitution: higher than 2.56 to 3).

The hydrolysis reaction can be performed by reacting the raw material cellulose acetate with water in an organic solvent in the presence of a catalyst (ripening catalyst). Examples of the organic solvent include acetic acid, acetone, alcohols (e.g., methanol), and a mixed solvent of two or more of them. Among them, a solvent containing at least acetic acid is preferred. The catalyst may be one that is commonly used as a deacetylation catalyst, and is particularly preferably sulfuric acid.

The amount of the organic solvent (e.g., acetic acid) to be used is, for example, 0.5 to 50 parts by weight, preferably 1 to 20 parts by weight, more preferably 3 to 10 parts by weight per 1 part by weight of the raw material cellulose acetate.

The amount of the catalyst (e.g., sulfuric acid) to be used is, for example, 0.005 to 1 part by weight, preferably 0.01 to 0.5 parts by weight, even more preferably 0.02 to 0.3 parts by weight per 1 part by weight of the raw material cellulose acetate. If the amount of the catalyst is too small, there is a case where the time of hydrolysis is too long so that the molecular weight of cellulose acetate is reduced. On the other hand, if the amount of the catalyst is too large, the degree of change in the rate of depolymerization depending on the temperature of hydrolysis is large, and therefore the rate of depolymerization is high even when the temperature of hydrolysis is relatively low, which makes it difficult to obtain cellulose acetate having a relatively large molecular weight.

The amount of water used in the hydrolysis step is, for example, 0.5 to 20 parts by weight, preferably 1 to 10 parts by weight, more preferably 2 to 7 parts by weight per 1 part by weight of the raw material cellulose acetate. Further, the amount of water is, for example, 0.1 to 5 parts by weight, preferably 0.3 to 2 parts by weight, more preferably 0.5 to 1.5 parts by weight per 1 part by weight of the organic solvent (e.g., acetic acid). The total amount of water to be used may be present in the system at the start of the reaction. However, in order to prevent the precipitation of cellulose acetate, part of water to be used may be present in the system at the start of the reaction, and then the remaining water may be added to the system once or in several batches.

The temperature of the reaction in the hydrolysis step is, for example, 40 to 130° C., preferably 50 to 120° C., more preferably 60 to 110° C. Particularly, when the temperature of the reaction is 90° C. or higher (or higher than 90° C.), the equilibrium of the reaction tends to shift toward the direction that the rate of a reverse reaction (acetylation reaction) relative to a forward reaction (hydrolysis reaction) increases. As a result, the substitution degree distribution becomes narrow so that cellulose acetate with a low degree of substitution having a very small compositional distribution index CDI can be obtained without particularly performing posttreatment under adjusted conditions. In this case, a strong acid such as sulfuric acid is preferably used as the catalyst, and an excessive amount of acetic acid is preferably used as the reaction solvent. Further, even when the temperature of the reaction is 90° C. or less, as will be described later, cellulose acetate with a low degree of substitution having a very small compositional distribution index CDI can be obtained by performing precipitation using a mixed solvent containing two or more solvents as a precipitation solvent or by performing precipitation fractionation and/or dissolution fractionation in the precipitation step.

[(B) Precipitation Step]

In this step, after the completion of the hydrolysis reaction, the temperature of the reaction system is reduced to room temperature, and a precipitation solvent is added to the reaction system to precipitate cellulose acetate with a low degree of substitution. The precipitation solvent may be an organic solvent miscible with water or an organic solvent having high solubility in water. Examples of the precipitation solvent include ketones such as acetone and methyl ethyl ketone; alcohols such as methanol, ethanol, and isopropyl alcohol; esters such as ethyl acetate; nitrogen-containing compounds such as acetonitrile; ethers such as tetrahydrofuran; and mixed solvents of two or more of them.

The use of a mixed solvent containing two or more solvents as the precipitation solvent produces the same effect as precipitation fractionation that will be described later, and therefore make it possible to obtain cellulose acetate with a low degree of substitution having a narrow compositional distribution (intermolecular substitution degree distribution) and a small compositional distribution index (CDI). Preferred examples of the mixed solvent include a mixed solvent of acetone and methanol and a mixed solvent of isopropyl alcohol and methanol.

The cellulose acetate with a low degree of substitution obtained by precipitation may further be subjected to precipitation fractionation (fractional precipitation) and/or dissolution fractionation (fractional dissolution). This makes it possible to obtain cellulose acetate with a low degree of substitution having a narrow compositional distribution (intermolecular substitution degree distribution) and a very small compositional distribution index (CDI).

The precipitation fractionation can be performed, for example, in the following manner. The cellulose acetate with a low degree of substitution (solid) obtained by precipitation is dissolved in water to obtain an aqueous solution having an appropriate concentration (e.g., 2 to 10 wt %, preferably 3 to 8 wt %), a poor solvent is added to the aqueous solution (or the aqueous solution is added to a poor solvent) and the resulting mixture is maintained at an appropriate temperature (e.g., 30° C. or lower, preferably 20° C. or lower) to precipitate cellulose acetate with a low degree of substitution, and then the thus obtained precipitate is collected. Examples of the poor solvent include alcohols such as methanol and ketones such as acetone. The amount of the poor solvent to be used is, for example, 1 to 10 parts by weight, preferably 2 to 7 parts by weight per 1 part by weight of the aqueous solution.

The dissolution fractionation can be performed, for example, in the following manner. A mixed solvent of water and an organic solvent (e.g., a ketone such as acetone or an alcohol such as ethanol) is added to the cellulose acetate with a low degree of substitution (solid) obtained by precipitation or the cellulose acetate with a low degree of substitution (solid) obtained by precipitation fractionation, the resulting mixture is stirred at an appropriate temperature (e.g., 20 to 80° C., preferably 25 to 60° C.), and is then separated into a dense phase and a dilute phase by centrifugation, and a precipitation solvent (e.g., a ketone such as acetone or an alcohol such as methanol) is added to the dilute phase to collect a precipitate (solid). The mixed solvent of water and an organic solvent has an organic solvent concentration of, for example, 5 to 50 wt %, preferably 10 to 40 wt %.

[(C) Washing and Precipitation Step]

The precipitate (solid) obtained in the precipitation step (B) is preferably washed with an organic solvent (poor solvent) such as an alcohol (e.g., methanol) or a ketone (e.g., acetone). The precipitate is also preferably washed and neutralized with an organic solvent (e.g., an alcohol such a methanol or a ketone such as acetone) containing a basic substance.

Examples of the basic substance include: alkali metal compounds (e.g., alkali metal hydroxides such as sodium hydroxide and potassium hydroxide; alkali metal carbonates such as sodium carbonate and potassium carbonate; alkali metal hydrogen carbonates such as sodium hydrogen carbonate; alkali metal carboxylates such as sodium acetate and potassium acetate; and sodium alkoxides such as sodium methoxide and sodium ethoxide); alkaline-earth metal compounds (e.g., alkaline-earth metal hydroxides such as magnesium hydroxide and calcium hydroxide; alkaline-earth metal carbonates such as magnesium carbonate and calcium carbonate; alkaline-earth metal carboxylates such as magnesium acetate and calcium acetate; and alkaline-earth metal alkoxides such as magnesium ethoxide). Among them, alkali metal compounds such as potassium acetate are particularly preferred.

The washing and neutralization can efficiently remove impurities such as the catalyst (e.g, sulfuric acid) used in the hydrolysis step.

[Cellulose Acetate Fiber]

The average fiber diameter of the cellulose acetate fiber according to the present invention is preferably 0.1 to 1 μm, more preferably 0.1 to 0.8 μm, even more preferably 0.1 to 0.5 μm. When the average fiber diameter is 1 μm or less, the case of using this fiber for a cigarette filter makes the filter excellent in performances, appropriate in air-flow resistance, and excellent in reducing rate of phenol. When the average fiber diameter is 0.1 μm or more, the case of using this fiber for a cigarette filter requires no special attention to the handling of the fiber from the viewpoint of health, safety and others since the fiber is not regarded as the so-called nano-material.

In the present invention, the average fiber diameter of the cellulose acetate fiber is a value calculated out from the respective fiber diameters obtained by measuring the fibers (n=about 20) through an electron microscopic photograph.

A method for producing the cellulose acetate fiber according to the present invention is not particularly limited. The fiber can be produced, for example, by spinning a predetermined cellulose acetate by electrospinning.

In the present invention, the cellulose acetate fiber includes the cellulose acetate fiber and a cellulose acetate fiber assembly.

(Electrospinning)

Herein, electrospinning is a method in which a high voltage is applied to a nozzle to make an electric field between the nozzle and a collector, the voltage is applied to a solution (spinning solution) containing a polymer dissolved therein for being jetted out from the nozzle, and fiber filaments are deposited onto the collector to yield a fiber.

When the cellulose acetate fiber according to the present invention is produced by electrospinning, a known method can be used which is described in Maria E. Vallejos, Maria S. Peresin, Orlando J. Rojas, "All-Cellulose Composite Fibers Obtained by Electrospinning Dispersions of Cellulose Acetate and Cellulose Nanocrystals", Journal of Polymers and the Environment, published online: 1 Aug. 2012.

A solvent in which cellulose acetate of the cellulose acetate fiber according to the present invention is soluble is not particularly limited as far as the solvent is a solvent which permits the cellulose acetate to be soluble in the solvent, evaporates at a stage of spinning the cellulose acetate by electrospinning, and permits the production of the fiber. From the viewpoint of dissolving performance and handleability, an appropriate solvent is selectable. However, the cellulose acetate contained in the cellulose acetate fiber according to the present invention is water-soluble so that the solvent is preferably water or a water/alcohol mixture from the viewpoint of decreasing a load based on the use of the organic solvent to the environment.

When a water/acetic acid mixture is used as the solvent, acetic acid which remains in cellulose acetate promotes acid-catalyst hydrolysis of the cellulose acetate fiber to lower the fiber in storage stability easily. The remaining acetic acid also generates an acetic acid odor. It is therefore required to perform a washing step after the fiber formation. This case becomes more complicated in steps than the case of using water, or a water/alcohol mixture. It is therefore preferred from the viewpoint of production process to use water, or a water-alcohol mixture as the solvent.

In the preparation of the spinning solution other polymer or compound may be used together as far as the advantageous effects of the present invention are not hindered. For example, polyvinyl alcohol or polyethylene glycol may be used together to prepare a mixture body or crosslinked body of the alcohol or glycol with cellulose acetate used in the present invention. Moreover, a surfactant, a deodorant or the like may be added to the body in order to adjust the spinnability of cellulose acetate, or improve the resulting fiber product in physical properties or give a function to the product. Examples of the surfactant include polyoxyethylene sorbitan monolaurate and linear alkyl benzenesulfonate. The deodorant is, for example, activated carbon.

The cellulose acetate concentration in the spinning solution, the internal diameter of the nozzle, the applied voltage, the distance between the nozzle and the collector (distance between electrodes), the feed speed, and others may be appropriately varied in accordance with a target average fiber diameter of the resulting fiber. When a cellulose acetate fiber having an average fiber diameter of 0.1 to 1 μm is produced, it is preferred that the cellulose acetate concentration in the spinning solution is 5 to 20% by weight; the internal diameter of the nozzle is 27 to 18 G (0.4 to 1.2 mm); the applied voltage is 10 to 40 kV; the distance between the nozzle and the collector (distance between electrodes) is 5 to 30 cm; and the feed speed is 0.1 to 5 mL/min. The material of the surface of the collector is preferably aluminum foil.

[Cellulose Acetate Fiber Molded Article]

The cellulose acetate fiber molded article in the present invention denotes a structural body comprising the above-mentioned cellulose acetate fiber. The form of the structural body may be various forms, and examples thereof include a nonwoven fabric form, a woven fabric form, a twisted fiber form, a cotton form, and a sheet form.

The molded article can be produced by processing a cellulose acetate fiber obtained by the above-mentioned method into a target form by a known method.

(Water Solubility)

The water solubility of the cellulose acetate fiber or cellulose acetate fiber molded article according to the present invention can be evaluated by the method described in the section "Examples".

(Biodegradability)

The biodegradability of the cellulose acetate fiber or cellulose acetate fiber molded article according to the present invention can be evaluated by the method described in the section "Examples".

EXAMPLES

Hereinbelow, the present invention will be specifically described with reference to examples. However, the technical scope of the present invention is not limited to these examples.

Example 1

(Cellulose Acetate)

To 1 part by weight of cellulose acetate (trade name: "L-50", manufactured by Daicel Corporation; total degree of acetyl substitution: 2.43; 6% viscosity: 110 mPa·s) were added 5.1 parts by weight of acetic acid and 2.0 parts by weight of water. The mixture was stirred for 3 hours to dissolve cellulose acetate.

To this cellulose acetate solution was added 0.13 parts by weight of sulfuric acid. The resulting solution was kept at 70° C. to conduct hydrolysis (partially deacetylation reaction; ripening). During the hydrolysis, in order to prevent the precipitation of cellulose acetate, water was added to the system two times. More specifically, ripening in the first time (first ripening) was conducted for 1 hour, and then 0.67 parts by weight of water was added to the system over 5 minutes. Subsequent ripening (second ripening) was conducted for 2 hours. Thereafter, 1.33 parts by weight of water was added to the system over 10 minutes, and further third ripening was conducted for 6 hours (the step from the start of the reaction to the first addition of water is referred to as a first hydrolysis step (first ripening step); the step from the first addition of water to the second addition of water is referred to as a second hydrolysis step (second ripening step); and the step from the second addition of water to the end of the reaction is referred to as a third hydrolysis step (third ripening step)).

After the hydrolyses were conducted, the temperature of the system was cooled to room temperature (about 25° C.), To the reaction mixture was added 15 parts by weight of an acetone/methanol (=1/2, w/w (ratio by weight)) mixed solution (precipitating agent) to produce a precipitate.

The precipitate was collected as a wet cake having a solid content of 15 wt %. Thereto was added 8 parts by weight of methanol. From the wet cake, the liquid was removed into a solid content of 15 wt % to wash the cake. This operation was repeated three times. The washed precipitate was further washed two times with 8 parts by weight of methanol containing 0.004 wt % of potassium acetate, neutralized and dried to obtain cellulose acetate with a low degree of substitution (WSCA-70-0.9).

(Measurement of Total Degree of Acetyl Substitution)

Unsubstituted hydroxyl groups of the obtained cellulose acetate with a low degree of substitution (WSCA-70-0.9) as a cellulose acetate sample with a low degree of substitution were propionylated in accordance with the method of Tezuka (Carbohydr. Res. 273, 83 (1995)). The total degree of acetyl substitution of the propionylated cellulose acetate with a low degree of substitution was determined from the signals of acetyl carbonyl at 169 to 171 ppm and the signals of propionyl carbonyl at 172 to 174 ppm in 13C-NMR in accordance with the method of Tezuka (idem). The results are shown in Table 1.

(Measurement of Weight-Average Degree of Polymerization (DPw))

The weight-average degree of polymerization (DPw) of the obtained cellulose acetate with a low degree of substitution (WSCA-70-0.9) was determined by GPC-light scattering measurement under the following conditions after conversion into propionylated cellulose acetate.

Apparatus: GPC "SYSTEM-21H" manufactured by Shodex

Solvent: acetone

Column: two GMH×1 columns (Tosoh) with a guard column (Tosoh)

Flow Rate: 0.8 mL/min

Temperature: 29° C.

Sample Concentration: 0.25% (wt/vol)

Injection Volume: 100 μL

Detection: MALLS (Multi-Angle Laser Light Scattering Detector) ("DAWN-EOS" manufactured by Wyatt)

Reference Material for MALLS correction: PMMA (molecular weight: 27600)

(Measurement of Compositional Distribution Index (CDI))

The compositional distribution index (CDI) of the obtained cellulose acetate with a low degree of substitution (WSCA-70-0.9) was determined by HPLC analysis under the following conditions after conversion into propionylated cellulose acetate. The results are shown in Table 1.

Apparatus: Agilent 1100 Series

Column: Waters Nova-Pak phenyl 60 Å 4 μm (150 mm×3.9 mm(φ)+guard column

Column Temperature: 30° C.

Detection: Varian 380-LC

Injection Volume: 5.0 4 (Sample Concentration: 0.1% (wt/vol))

Eluant: Solution A: $MeOH/H_2O$=8/1 (v/v), Solution B: $CHCl_3$/MeOH=8/1 (v/v)

Gradient: A/B=80/20→0/100 (28 min); Flow Rate: 0.7 mL/min

First, preparations having a known total degree of acetyl substitution (DS) in the range of 0 to 3 were analyzed by HPLC to create a calibration curve of elution time vs. DS. Based on the calibration curve, an elution curve (time vs. detected intensity curve) of an unknown sample was converted into a DS vs. detected intensity curve (compositional distribution curve). An uncorrected half-width X of this compositional distribution curve was determined, and a corrected half-width Z of compositional distribution was determined by the following formula (1). The Z is a measured value of the half-width of compositional distribution.

$$Z=(X^2-Y^2)^{1/2} \quad (1), \text{ wherein}$$

X is an uncorrected half-width of a compositional distribution curve determined with a predetermined measuring apparatus under predetermined measuring conditions, and Y is an apparatus constant defined by the following formula:

$$Y=(a-b)\times/3+b(0\leq x\leq 3), \text{ wherein}$$

a: apparent half-width of compositional distribution of acetate cellulose having a total degree of substitution of 3 determined with the same measuring apparatus under the same measuring conditions as in the determination of the above X (actually, the cellulose acetate has a total degree of substitution of 3 and therefore does not have a substitution degree distribution), b: apparent half-width of compositional distribution of cellulose propionate having a total degree of substitution of 3 determined with the same measuring apparatus under the same measuring conditions as in the determination of the above X, and x: total degree of acetyl substitution of a measurement sample (0≤x≤3).

From the Z (measured value of half-width of compositional distribution), the compositional distribution index (CDI) is determined by the following formula (2):

$$CDI=Z/Z_0 \quad (2), \text{ wherein}$$

$Z_0$ is a theoretical value of the half-width of compositional distribution of a compositional distribution curve generated when acetylation and partial deacetylation in the preparation of all the partially-substituted cellulose acetates occur with equal probability among all the hydroxyl groups (or acetyl groups) of all the molecules. The $Z_0$ is defined by the following formula (4):

[Formula 3]

$$\text{Theoretical value of half-width of compositional distribution} = \frac{2.35482\times\sqrt{3\times DPw\times\frac{DS}{3}\times\left(1-\frac{DS}{3}\right)}}{DPw}, \quad (4)$$

wherein

DS: total degree of acetyl substitution, and

DPw: weight-average degree of polymerization (value determined by GPC-light scattering using cellulose acetate propionate obtained by propionylating all the residual hydroxyl groups of the cellulose acetate).

(Electrospinning)

Into 91 parts by weight of an ethanol/water (=8/2, w/w (ratio by weight)) mixed solution was dissolved 9 parts by weight of the cellulose acetate with a low degree of substitution (WSCA-70-0.9) to prepare a spinning solution. An apparatus illustrated in FIG. 1 was used to subject the solution to electrospinning under conditions described in Table 2 to obtain a cellulose acetate fiber.

(Average Fiber Diameter)

The average fiber diameter of the cellulose acetate fiber was calculated out by photographing the fibers through a scanning electron microscope (SEM) at a magnification of 50000, drawing two lines at arbitrary positions traversing the photograph, counting the respective fiber diameters of all the fibers (n=20 or more) crossing the lines, and then averaging the diameters. The manner of drawing the lines is not particularly limited as far as the number of the fibers crossing the lines becomes 20 or more. Furthermore, from the measured value of the fiber diameter, the standard deviation of the fiber diameter distribution, and the maximum fiber diameter were determined. When the fiber was a cellulose acetate fiber having a maximum fiber diameter more than 1 μm, an SEM photograph at a magnification of 5000 was used to calculate out the average fiber diameter.

(Water Solubility Evaluation)

Distilled water was weighed by 100 g, and the water was put into a 200 mL sample bottle, and thereto was added 10 mg of the obtained cellulose acetate fiber. The bottle was allowed to stand still at room temperature (22° C.) for 15 hours. Thereafter, the sample bottle was shaken for 20 seconds, and then allowed to stand still for 1 hour. When the form of the cellulose acetate fiber was substantially disappeared, the fiber was determined to be soluble; or when the form of the cellulose acetate fiber was substantially kept, the fiber was determined to be insoluble. The result is shown in Table 3.

(Biodegradability Evaluation)

Activated sludge available from the Tataragawa Purification Center in Fukuoka Prefecture was allowed to stand still for 1 hour, and then 300 mL of the resulting supernatant (activated sludge concentration: 360 ppm) was put into a culture bottle. Thereto was added 30 mg of the cellulose acetate fiber. A coulometer, OM3001, manufactured by Ohkura Electric Co., Ltd. was used to measure the biochemical oxygen demand (BOD) in the culture bottle at 25° C. after 10 days, 20 days, 30 days, and 60 days. For the BOD, a blank measurement was made. The BOD was defined as a value obtained by subtracting the blank value from the measured value. Based on the chemical composition of cellulose acetate, a theoretical BOD value of the fiber was calculated out in a complete decomposition state, and the percentage of the measured value to this theoretical BOD value was defined as a decomposition rate. The result is shown in Table 3.

Example 2

(Cellulose Acetate)

Cellulose acetate with a low degree of substitution (WSCA-70-0.9) was obtained in the same manner as in Example 1.

The total degree of acetyl substitution and the compositional distribution index (CDT) were measured in the same manner as in Example 1. The results are shown in Table 1.

(Electrospinning)

A spinning solution was prepared in the same manner as in Example 1. The apparatus illustrated in FIG. 1 was used to subject the solution to electrospinning under conditions shown in Table 2 so that a cellulose acetate fiber was obtained.

The average fiber diameter, the water solubility and the biodegradability were also evaluated in the same manner as in Example 1. The results are shown in Table 3.

(Evaluation of Fiber as Cigarette Smoke Filter)

BET Specific Surface Area

With respect to the resulting cellulose acetate fiber, the BET specific surface area thereof was measured by the method described in JP 2012-102250 A. The result is shown in Table 4.

Air Resistance and Reducing Rate of Phenol

The fiber was used as a cigarette sample having a triplet structure filter to evaluate the air resistance and the reducing rate of phenol by the methods described in JP 2012-95590 A. Specifically, the methods are as described below. The results are shown in Table 4.

A cigarette sample having a triplet structure filter was prepared as follows.

In a filter body (25 mm) of a cellulose diacetate crimped fiber tow of a commercially available cigarette ["Peace Light Box" (Registered Trademark No. 2122839) manufactured by Japan Tobacco, Inc.], a part of the filter body (20 mm from the end) was cut with a razor. A glass tube (length: 25 mm, and internal diameter: 8 mm) was inserted into a filter region of a tobacco-leaf-filled piece by a length (5 mm) corresponding to the length of the remaining-filter length of the long piece (to the tobacco-leaf-filled end). These were then bonded to each other through a sealing tape. The resulting cellulose acetate fiber was cut into a length of about 10 mm, and 80 mg of the cut fiber was filled into a space of the glass tube having a length of 10 mm which was projected by the glass tube insertion. At this time, adjustment was made to set a length over which the cellulose acetate fiber occupied the inside of the glass tube to 10 mm. Next, the previously-cut original filter piece (that is, the 20-mm-length filter region) was cut at its site 10 mm apart from its cigarette-smoking side end with a razor. This was inserted into the glass tube at the opening end side by 5 mm to stop the end. A sealing tape was wound also onto a connecting part between the glass tube and the filter to seal the glass tube airtightly. In this way, each cigarette sample for a smoking test was obtained. Accordingly, the length of the filter made of the cellulose diacetate crimped fiber tow is 25 mm. Moreover, instead of the cellulose acetate fiber obtained in Example 2, the original filter of Peace Light Box was used to obtain a reference cigarette in the same manner as above.

The air resistance was determined as a pressure loss (mmWG) measured by an automatic air-resistance-measuring apparatus ("QTM-6" manufactured by CERULEAN, the U.K.) at an air flow rate of 17.5 ml/second.

The amount of phenol contained in mainstream smoke by smoking the prepared cigarette sample having a triplet structure filter was measured in accordance with Test Method T-114 "Determination of Phenolic Compounds in Mainstream Tobacco Smoke" of Health Canada. More specifically, a particulate matter contained in mainstream smoke of each of five samples subjected to a smoking machine was collected by a Cambridge filter. The phenol collected in the filter was extracted with 1% acetic acid aqueous solution. The phenol contained in the extract was separated by a reverse phase gradient liquid chromatography, detected by a wavelength-selective fluorometry, and quantitatively determined using a working curve made by highly purified phenol (purity: not less than 99%). Further, the reducing rate of phenol was calculated by the following formula. In the formula, Tp represents the amount of phenol collected from the reference cigarette, and Cp represents the amount of phenol collected from the prepared cigarette sample having a triplet structure filter.

$$\text{Reducing rate of phenol (\%)}=100\times(1-Cp/Tp)$$

Example 3

(Cellulose Acetate)

Cellulose acetate with a low degree of substitution (WSCA-70-0.8) was obtained in the same manner as in Example 1 except that the third ripening period was changed to 7 hours and the precipitating agent was changed to an acetone/methanol (=1/1, w/w (ratio by weight)) mixed solution.

The total degree of acetyl substitution and the compositional distribution index (CDI) were also measured in the same manner as in Example 1. The results are shown in Table 1.

(Electrospinning)

Into 89.7 parts by weight of an ethanol/water (=8/2, w/w (ratio by weight)) mixed solution containing 0.3 parts by weight of TWEEN 20 was dissolved 10 parts by weight of the cellulose acetate with a low degree of substitution (WSCA-70-0.8) to prepare a spinning solution. The apparatus illustrated in FIG. 1 was used to subject the solution to electrospinning under conditions shown in Table 2 so that a cellulose acetate fiber was obtained.

The average fiber diameter, the water solubility and the biodegradability were also evaluated in the same manner as in Example 1. The results are shown in Table 3.

Example 4

(Cellulose Acetate)

Cellulose acetate with a low degree of substitution (WSCA-70-0.8) was obtained in the same manner as in Example 3.

The total degree of acetyl substitution and the compositional distribution index (CDI) were also measured in the same manner as in Example 1. The results are shown in Table 1.

(Electrospinning)

A spinning solution was prepared in the same manner as in Example 3. The apparatus illustrated in FIG. 1 was used to subject the solution to electrospinning under conditions shown in Table 2 so that a cellulose acetate fiber was obtained.

The average fiber diameter, the water solubility and the biodegradability were also evaluated in the same manner as in Example 1. The results are shown in Table 3.

Example 5

(Cellulose Acetate)

Low-substitution-degree cellulose acetate (WSCA-70-0.5) was obtained in the same manner as in Example 1 except that the third ripening period was changed to 11 hours and the precipitating agent was changed to an acetone/2-propanol (=1/2, w/w (ratio by weight)) mixed solution.

The total degree of acetyl substitution and the compositional distribution index (CDI) thereof were also evaluated in the same manner as in Example 1. The results are shown in Table 1.

(Electrospinning)

Into 89.7 parts by weight of an ethanol/water (=8/2, w/w (ratio by weight)) mixed solution containing 0.3 parts by weight of TWEEN 20 was dissolved 10 parts by weight of the cellulose acetate with a low degree of substitution (WSCA-70-0.5) to prepare a spinning solution. The apparatus illustrated in FIG. 1 was used to subject the solution to electrospinning under conditions shown in Table 2 so that a cellulose acetate fiber was obtained.

The average fiber diameter, the water solubility and the biodegradability were also evaluated in the same manner as in Example 1. The results are shown in Table 3.

Example 6

Cellulose acetate with a low degree of substitution (WSCA-40-1.1) was obtained in the same manner as in Example 1 except that the third ripening period was changed to 4 hours.

The total degree of acetyl substitution and the compositional distribution index (CDI) were also measured in the same manner as in Example 1. The results are shown in Table 1.

(Electrospinning)

Into 90.7 parts by weight of an ethanol/water (=8/2, w/w (ratio by weight)) mixed solution containing 0.3 parts by weight of TWEEN 20 was dissolved 9 parts by weight of the cellulose acetate with a low degree of substitution (WSCA-70-1.1) to prepare a spinning solution. The apparatus illustrated in FIG. 1 was used to subject the solution to electrospinning under conditions shown in Table 2 so that a cellulose acetate fiber was obtained.

The average fiber diameter, the water solubility and the biodegradability were also evaluated in the same manner as in Example 1. The results are shown in Table 3.

Comparative Example 1

(Cellulose Acetate)

"L-50" (manufactured by Daicel Corporation; total degree of acetyl substitution: 2.43; 6% viscosity: 110 mPa·s) was used as cellulose acetate.

(Electrospinning)

Into 75 parts by weight of an acetone/dimethylacetoamide (=2/1, w/w (ratio by weight)) mixed solution was dissolved 25 parts by weight of the cellulose acetate ("L-50") to prepare a spinning solution. The apparatus illustrated in FIG. 1 was used to subject the solution to electrospinning under conditions shown in Table 2 so that a cellulose acetate fiber was obtained.

The average fiber diameter, the water solubility and the biodegradability were also evaluated in the same manner as in Example 1. The results are shown in Table 3.

Comparative Example 2

(Cellulose Acetate)

In the same manner as in Comparative Example 1, "L-50" (manufactured by Daicel Corporation; total degree of acetyl substitution: 2.43; 6% viscosity: 110 mPa·s) was used as cellulose acetate.

(Electrospinning)

Into 80 parts by weight of a dimethylformamide/amide (=3/1, w/w (ratio by weight)) mixed solution was dissolved 20 parts by weight of the cellulose acetate ("L-50") to prepare a spinning solution. The apparatus illustrated in FIG.

1 was used to subject the solution to electrospinning under conditions shown in Table 2 so that a cellulose acetate fiber was obtained.

The average fiber diameter, the water solubility and the biodegradability were also evaluated in the same manner as in Example 1. The results are shown in Table 3.

Comparative Example 3

(Polyvinyl Alcohol)

"PVA 117" (manufactured by Kuraray Co., Ltd.; saponification degree: 98.7%; 4% viscosity: 28.2 mPa·s), was used as polyvinyl alcohol.

(Electrospinning)

Into 90 parts by weight of water was dissolved 10 parts by weight of the polyvinyl alcohol (PVA 117) to prepare a spinning solution. The apparatus illustrated in FIG. 1 was used to subject the solution to electrospinning under conditions shown in Table 2 so that a cellulose acetate fiber was obtained.

(Average Fiber Diameter)

The average fiber diameter of the polyvinyl alcohol was calculated out in the same manner as in Example 1. The results are shown in Table 3.

The water solubility and the biodegradability were also evaluated in the same manner as in Example 1. The result is shown in Table 3.

Comparative Example 4

(Polyvinyl Alcohol)

In the same manner as in Comparative Example 4, "PVA 117" (manufactured by Kuraray Co., Ltd.; saponification degree: 98.7%; 4% viscosity: 28.2 mPa·s) was used as polyvinyl alcohol.

(Electrospinning)

Into 90 parts by weight of water was dissolved 10 parts by weight of the polyvinyl alcohol (PVA 117) to prepare a spinning solution. The apparatus illustrated in FIG. 1 was used to subject the solution to electrospinning under conditions shown in Table 2 so that a polyvinyl alcohol fiber was obtained.

(Average Fiber Diameter)

The average fiber diameter of the polyvinyl alcohol was calculated out in the same manner as in Example 1. The result is shown in Table 3.

The water solubility and the biodegradability were also evaluated in the same manner as in Example 1. The results are shown in Table 3.

Comparative Example 5

(Cellulose Acetate)

Cellulose acetate with a low degree of substitution (WSCA-40-0.9) was obtained in the same manner as in Example 1 except that: the reaction temperature was changed to 40° C.; the first ripening period was changed to 8 hours; the second ripening period was changed to 16 hours; the third ripening period was changed to 36 hours; and the precipitating agent was changed to methanol.

The total degree of acetyl substitution and the compositional distribution index (CDI) were also evaluated in the same manner as in Example 1. The results are shown in Table 3.

(Electrospinning)

Into 91 parts by weight of an ethanol/water (=8/2, w/w (ratio by weight)) mixed solution was dissolved 9 parts by weight of the cellulose acetate with a low degree of substitution (WSCA-40-0.9) to prepare a spinning solution. The apparatus illustrated in FIG. 1 was used to subject the solution to electrospinning under conditions shown in Table 2. However, the solution did not turned into any fiber form.

The water solubility and the biodegradability were also evaluated in the same manner as in Example 1. The results are shown in Table 3.

Comparative Example 6

(Cellulose Acetate)

Cellulose acetate with a low degree of substitution (WSCA-40-0.8) was obtained in the same manner as in Example 1 except that: the reaction temperature was changed to 40° C.; the first ripening period was changed to 8 hours; the second ripening period was changed to 16 hours; the third ripening period was changed to 42 hours; and the precipitating agent was changed to methanol.

The total degree of acetyl substitution and the compositional distribution index (CDI) were also evaluated in the same manner as in Example 1. The results are shown in Table 1.

(Electrospinning)

Into 90 parts by weight of an ethanol/water (=8/2, w/w (ratio by weight)) mixed solution were dissolved 10 parts by weight of the cellulose acetate with a low degree of substitution (WSCA-40-0.8) to prepare a spinning solution. The apparatus illustrated in FIG. 1 was used to subject the solution to electrospinning under conditions shown in Table 2. However, the solution did not turned into any fiber form.

The water solubility and the biodegradability thereof were also evaluated in the same manner as in Example 1. The results are shown in Table 3.

Comparative Example 7

(Cellulose Acetate)

Cellulose acetate (Sigma-Aldrich-CA 1.5) manufactured by Sigma-Aldrich was used as cellulose acetate.

(Electrospinning)

Into 83 parts by weight of an acetic acid/water (=85/15, w/w (ratio by weight)) mixed solution was dissolved 17 parts by weight of the cellulose acetate (Sigma-Aldrich-CA 1.5) to prepare a spinning solution. The apparatus illustrated in FIG. 1 was used to subject the solution to electrospinning under conditions shown in Table 2 so that a cellulose acetate fiber was obtained.

The average fiber diameter, the water solubility and the biodegradability were also evaluated in the same manner as in Example 1. The results are shown in Table 3.

Comparative Example 8

(Cellulose Acetate)

Cellulose acetate with a low degree of substitution (WSCA-70-0.9) was obtained in the same manner as in Example 1.

The total degree of acetyl substitution and the compositional distribution index (CDI) were also evaluated in the same manner as in Example 1. The results are shown in Table 1.

(Wet Sinning)

Into 90 parts by weight of water was dissolved 10 parts by weight of the cellulose acetate with a low degree of substitution (WSCA-70-0.9) to prepare a spinning solution.

This spinning solution was pushed out through a syringe having an internal diameter of 0.3 mm into an excessive amount of ethanol to obtain a cellulose acetate fiber. The amount of ethanol was set to an amount 20 times the weight of the aqueous solution in the composition obtained after the completion of the pushing. The resulting fiber was dried into a constant weight at 60° C. under reduced pressure.

The average fiber diameter after the drying was evaluated in the same manner as in Example 1. The diameter was about 30 μm (30,000 nm). The water solubility and the biodegradability were also evaluated in the same manner as in Example 1. The results are shown in Table 3. The fineness was 9 deniers.

(Evaluation as Cigarette Smoke Filter)

In the same manner as in Example 2, the BET specific surface area, the air resistance and the reducing rate of phenol were evaluated. The results are shown in Table 4.

TABLE 1

| | | Polymer species | Compositional distribution index (CDI) | Total degree of acetyl substitution (DS) |
|---|---|---|---|---|
| Example 1 | WSCA-70-0.9 | Cellulose acetate with low degree of substitution | 1.4 | 0.87 |
| Example 2 | WSCA-70-0.9 | Cellulose acetate with low degree of substitution | 1.4 | 0.87 |
| Example 3 | WSCA-70-0.8 | Cellulose acetate with low degree of substitution | 1.4 | 0.81 |
| Example 4 | WSCA-70-0.8 | Cellulose acetate with low degree of substitution | 1.4 | 0.81 |
| Example 5 | WSCA-70-0.5 | Cellulose acetate with low degree of substitution | 1.6 | 0.51 |
| Example 6 | WSCA-70-1.1 | Cellulose acetate with low degree of substitution | 1.4 | 1.1 |
| Comparative Example 1 | "L-50" (manufactured by Daicel Corporation) | Cellulose acetate | 2.6 | 2.43 |
| Comparative Example 2 | "L-50" (manufactured by Daicel Corporation) | Cellulose acetate | 2.6 | 2.43 |
| Comparative Example 3 | "PVA 117" (manufactured by Kuraray Co., Ltd.) | Polyvinyl alcohol | — | — |
| Comparative Example 4 | "PVA 117" (manufactured by Kuraray Co., Ltd.) | Polyvinyl alcohol | — | — |
| Comparative Example 5 | WSCA-40-0.9 degree of substitution | Cellulose acetate with low | 2.4 | 0.87 |
| Comparative Example 6 | WSCA-40-0.8 | Cellulose acetate with low degree of substitution | 2.1 | 0.79 |
| Comparative Example 7 | Sigma-Aldrich-CA1.5 (manufactured by Sigma-Aldrich) | Cellulose acetate | 2.7 | 1.5 |
| Comparative Example 8 | WSCA-70-0.9 | Cellulose acetate with low degree of substitution | 1.4 | 0.87 |

TABLE 2

| | Solvent | Polymer concentration (wt %) | Surfactant | Nozzle diameter (G) | Applied voltage (kV) | Distance (cm) between electrodes | Feed speed (ml/min) | Spun-yarn side electrode (collector) | Spinnable or unspinnable |
|---|---|---|---|---|---|---|---|---|---|
| Example 1 | Ethanol/water (8/2, w/w) | 9 | — | 22 | 25 | 13 | 1.0 | Aluminum foil | Spinnable |
| Example 2 | Ethanol/water (8/2, w/w) | 9 | — | 25 | 25 | 13 | 0.2 | Aluminum foil | Spinnable |
| Example 3 | Ethanol/water (8/2, w/w) | 10 | TWEEN 20, 0.3% | 22 | 25 | 13 | 1.0 | Aluminum foil | Spinnable |
| Example 4 | Ethanol/water (8/2, w/w) | 10 | TWEEN 20, 0.3% | 25 | 25 | 13 | 0.2 | Aluminum foil | Spinnable |
| Example 5 | Ethanol/water (8/2, w/w) | 10 | TWEEN 20, 0.3% | 22 | 25 | 13 | 1.0 | Aluminum foil | Spinnable |
| Example 6 | Ethanol/water (8/2, w/w) | 9 | TWEEN 20, 0.3% | 22 | 25 | 13 | 1.0 | Aluminum foil | Spinnable |
| Comparative Example 1 | Acetone/ dimethylacetoamide (3/1, w/w) | 25 | — | 22 | 10 | 15 | 3.0 | Aluminum foil | Spinnable |
| Comparative Example 2 | Dimethylformamide/ acetone (2/1, w/w) | 20 | — | 25 | 25 | 13 | 1.0 | Aluminum foil | Spinnable |
| Comparative Example 3 | Water | 10 | — | 23 | 10 | 10 | 0.3 | Aluminum foil | Spinnable |
| Comparative Example 4 | Water | 10 | — | 25 | 15 | 20 | 0.2 | Aluminum foil | Spinnable |
| Comparative Example 5 | Ethanol/water (8/2, w/w) | 9 | — | 22 | 25 | 13 | 1.0 | Aluminum foil | Unspinnable (bead form) |
| Comparative Example 6 | Ethanol/water (8/2, w/w) | 10 | TWEEN 20, 0.3% | 22 | 25 | 13 | 1.0 | Aluminum foil | Unspinnable (bead form) |

TABLE 2-continued

| | Solvent | Polymer concentration (wt %) | Surfactant | Nozzle diameter (G) | Applied voltage (kV) | Distance (cm) between electrodes | Feed speed (ml/min) | Spun-yarn side electrode (collector) | Spinnable or unspinnable |
|---|---|---|---|---|---|---|---|---|---|
| Comparative Example 7 | Acetic acid/water (85/15, w/w) | 17 | — | 27 | 25 | 15 | 2.0 | Aluminum foil | Spinnable |

TABLE 3

| | Average fiber diameter (nm) | Water solubility (0.01 wt % solution,visual observation) | Biodegradability (decomposition percent in accordance with days after activated sludge treatment) After 10 days | After 20 days | After 30 days | After 60 days |
|---|---|---|---|---|---|---|
| Example 1 | 850 | Soluble | 68 | 77 | 84 | 89 |
| Example 2 | 300 | Soluble | 71 | 79 | 84 | 91 |
| Example 3 | 450 | Soluble | 69 | 77 | 85 | 90 |
| Example 4 | 100 | Soluble | 69 | 81 | 85 | 88 |
| Example 5 | 880 | Soluble | 72 | 83 | 88 | 92 |
| Example 6 | 890 | Soluble | 66 | 75 | 81 | 87 |
| Comparative Example 1 | 750 | Insoluble | 4 | 53 | 81 | 82 |
| Comparative Example 2 | 320 | Insoluble | 6 | 56 | 78 | 83 |
| Comparative Example 3 | 300 | Soluble | 0 | 0 | 4 | 68 |
| Comparative Example 4 | 120 | Soluble | 1 | 1 | 8 | 71 |
| Comparative Example 5 | — | — | — | — | — | — |
| Comparative Example 6 | — | — | — | — | — | — |
| Comparative Example 7 | 270 | Insoluble | 13 | 61 | 82 | 90 |
| Comparative Example 8 | 30,000 | Soluble | 65 | 75 | 83 | 87 |

TABLE 4

| | Fiber: Average fiber diameter (nm) | Fiber: BET specific surface area ($m^2/g$) | Cigarette sample having triplet structure filter: Air resistance (mmWG) | Cigarette sample having triplet structure filter: Reducing rate of phenol |
|---|---|---|---|---|
| Example 2 | 300 | 11.9 | 174 | 31 |
| Comparative Example 8 | 30,000 | <0.1 | 143 | −9 |

REFERENCE SIGNS LIST

1: syringe
2: nozzle
3: applied voltage
4: collector

The invention claimed is:

1. A cellulose acetate fiber comprising cellulose acetate having a total degree of acetyl substitution of 0.4 to 1.3; and a compositional distribution index (CDI) defined by a formula below of 1.4 to 2.0, the fiber having an average fiber diameter of 0.1 to 1 μm:

CDI=Z (measured value of half-width of compositional distribution)/$Z_0$ (theoretical value of half-width of compositional distribution), wherein Z: half-width of compositional distribution of degree of acetyl substitution determined by HPLC analysis of cellulose acetate propionate obtained by propionylating all residual hydroxyl groups of the cellulose acetate, and $$\text{theoretical value of half-width of compositional distribution} = \frac{2.35482 \times \sqrt{3 \times DPw \times \frac{DS}{3} \times \left(1 - \frac{DS}{3}\right)}}{DPw}, \quad \text{[Formula 1]}$$

wherein

Ds: total degree of acetyl substitution of the cellulose acetate, and

DPw: weight-average degree of polymerization (value determined by a GPC-light scattering using cellulose acetate propionate obtained by propionylating all residual hydroxyl groups of the cellulose acetate).

2. A cellulose acetate fiber molded article comprising the cellulose acetate fiber according to claim 1.

3. A method for producing the cellulose acetate fiber molded article according to claim 2, the method comprising:

a step of electrospinning a spinning dope in which cellulose acetate having a total degree of acetyl substitution of 0.4 to 1.3 and a compositional distribution index (CDI) defined by a formula below of 1.4 to 2.0 is dissolved in water or a water/alcohol mixed solvent; and a step of forming a molded article by using a resulting fiber, CDI=Z (measured value of half-width of compositional distribution)/$Z_0$ (theoretical value of half-width of compositional distribution), wherein Z: half-width of compositional distribution of degree of acetyl substitution determined by HPLC analysis of cellulose acetate propionate obtained by propionylating all residual hydroxyl groups of the cellulose acetate, and

[Formula 1]

$$\text{theoretical value of half-width of compositional distribution} = \frac{2.35482 \times \sqrt{3 \times DPw \times \frac{DS}{3} \times \left(1 - \frac{DS}{3}\right)}}{DPw},$$

wherein

Ds: total degree of acetyl substitution of the cellulose acetate, and

DPw: weight-average degree of polymerization (value determined by a GPC-light scattering using cellulose acetate propionate obtained by propionylating all residual hydroxyl groups of the cellulose acetate).

4. A method for producing the cellulose acetate fiber according to claim 1, the method comprising:

electrospinning a spinning dope in which cellulose acetate having a total degree of acetyl substitution of 0.4 to 1.3 and a compositional distribution index (CDI) defined by a formula below of 1.4 to 2.0 or lcsi is dissolved in water or a water/alcohol mixed solvent, CDI=Z (measured value of half-width of compositional distribution)/$Z_0$ (theoretical value of half-width of compositional distribution), wherein Z: half-width of compositional distribution of degree of acetyl substitution determined by HPLC analysis of cellulose acetate propionate obtained by propionylating all residual hydroxyl groups of the cellulose acetate, and

[Formula 1]

$$\text{theoretical value of half-width of compositional distribution} = \frac{2.35482 \times \sqrt{3 \times DPw \times \frac{DS}{3} \times \left(1 - \frac{DS}{3}\right)}}{DPw},$$

wherein

Ds: total degree of acetyl substitution of the cellulose acetate, and

DPw: weight-average degree of polymerization (value determined by a GPC-light scattering using cellulose acetate propionate obtained by propionylating all residual hydroxyl groups of the cellulose acetate).

5. The cellulose acetate fiber according to claim 1, wherein the total degree of acetyl substitution is 0.51 to 1.1, and the CDI is 1.4 to 1.6.

* * * * *